United States Patent [19]

Nakagawa et al.

[11] Patent Number: 4,675,997

[45] Date of Patent: Jun. 30, 1987

[54] ELECTRIC SHAVER POWERED BY RECHARGEABLE BATTERIES

[75] Inventors: Hisao Nakagawa, Shiga; Masao Matsumoto, Hikone, both of Japan

[73] Assignee: Matsushita Electric Works, Ltd., Japan

[21] Appl. No.: 809,016

[22] Filed: Dec. 16, 1985

[30] Foreign Application Priority Data

Dec. 21, 1984 [JP] Japan ..... 59-268627

[51] Int. Cl.[4] ..... B26B 19/38

[52] U.S. Cl. ..... 30/43; 30/43.9; 30/DIG. 1

[58] Field of Search ..... 30/DIG. 1, 41, 41.5, 30/41.6, 43, 43.7, 43.8, 43.9, 43.91, 43.92, 45; 204/247, 249; 320/46

[56] References Cited

U.S. PATENT DOCUMENTS 3,108,192 10/1963 Reich .

4,363,169 12/1982 Nasu et al. ..... 30/41

4,451,980 6/1984 Shirakawa et al. .

*Primary Examiner*—E. R. Kazenske

*Assistant Examiner*—Michael D. Folkerts

*Attorney, Agent, or Firm*—Stevens, Davis, Miller & Mosher

[57] ABSTRACT

A self-contained electric shaver capable of being used with water and powered from either a main or a reserve rechargeable battery comprises a housing having thereon a shaving head and accommodating therein the main and reserve rechargeable batteries. The housing also accommodates a motor drivingly connected to the shaving head for effecting a hair shearing operation. Terminal pins adapted to be connected to an external battery charger for feeding an electric charging current to the batteries extend in a sealed manner through respective apertures formed in the lower end wall of the housing. At least one drain pipe extends in a sealed manner through a vent hole also formed in the lower end wall for passing out of the housing the gas discharged from the batteries upon charging thereof. The terminal pins and the drain pipe, all concentrated to the lower end wall to extend therethrough, are sealed with respect to the corresponding apertures and vent hole for preventing the outside water from entering interior of the housing while allowing the discharged gas to be drained out of the housing.

4 Claims, 10 Drawing Figures

ELECTRIC SHAVER POWERED BY RECHARGEABLE BATTERIES

BACKGROUND OF THE INVENTION

1. Field of the Invention

The present invention is directed to an electric shaver powered by rechargeable batteries, and more particularly to a self-contained electric shaver which is selectively energized from either of main or reserve rechargeable batteries and is further made water-tight to be utilized as a wet shaver.

2. Description of the Prior Art

There has been proposed an electric shaver incorporating main and reserve rechargeable batteries for the purpose of continuously energizing the shaver by the reserve battery when the main battery is exhausted, as taught from U.S. Pat. No. 3,108,192 which illustrates an electric circuit for selectively energizing an appliance operating mechanism from either a main rechargeable battery or a reserve rechargeable battery. However, the prior shaver incorporating the main and reserve batteries has no provision of a water-tight sealing and is therefore not utilized for a wet shave.

While on the other hand, an electric shaver capable of being used as a wet shaver incorporating a rechargeable battery is disclosed in U.S. Pat. No. 4,451,980 which includes the provision of an arrangement of discharging the gas produced upon charging of the battery out of a housing of the shaver while preventing the water from entering the interior of the housing. The above gas-discharging and water-tight sealing arrangement is rather complicated and therefore would be further increased its complexity when a reserve battery is additionally incorporated into the shaver, which would be the cause of increasing manufacturing costs and at the same time of lowering reliability. Consequently, it is mostly desired for a self-contained electric shaver with a pair of main and reserve rechargeable batteries to have a structural feature which satisfies both the water-tight sealing and the gas-discharging performance in a simple construction.

SUMMARY OF THE INVENTION

In view of the above, the present invention has been devised so as to present an advantageous structural feature for establishing in an easy and simple manner a water-tight sealing as well as a gas-discharging path leading from the main and reserve rechargeable batteries to the exterior of the shaver. The electric shaver in accordance with the present invention comprises a sealed housing with a lower end wall, a shaving head mounted on the upper end of the housing, a motor drivingly connected to the shaving head through a water-tight sealing, and a pair of the main and reserve rechargeable batteries, and terminal pins to be connected to an external battery charger for feeding an electric charging current to said rechargeable batteries. Each of the terminal pins extends outwardly of the housing through a complementary aperture formed in the lower end wall of the housing for connection with the external battery charger. Said batteries are provided with duct means for passing therethrough the gas discharged from the batteries. The duct means includes at least one drain pipe of which an outlet end is fitted in a vent hole formed in the lower end wall of the housing for passing the discharged gas out of the housing. The engaging portions between the terminal pin and its corresponding aperture and between the drain pipe and its corresponding vent hole are sealed in a water-tight manner for preventing the outside water from entering the interior of the housing while allowing the gas from the batteries to be discharged out of the housing. With this arrangement, the sealing portions required for the drain pipe of the batteries and the terminal pins can be concentrated in the lower end wall of the housing so that the sealing can be easily effected as being limited thereto and without being directed to any other portions of the housing. This is most effective when the lower end plate is fitted with a single sealing member formed with a corresponding number of sealing elements for the respective sealing portions to be required.

Accordingly, it is therefore a primary object of the present invention to provide an electric shaver which is capable of being used as a wet shaver and in which the water-tight sealing and the gas-discharging arrangement can be obtained in a simplified manner.

The present invention further discloses other advantageous features such as a space-saving arrangement of the batteries and a motor to be powered thereby within the housing of the shaver.

In a preferred embodiment of the present invention, there is disclosed a still further advantageous arrangement of providing the gas-discharging path for each of the main and reserve batteries. Each battery is formed to includes a sealed envelop which has its anode end slotted for discharging the gas produced upon charging the battery and which has a anode plate at its anode end. Said drain pipe is integrally secured to the anode plate in such a manner as to leave therebetween an opening for leading the gas discharged from the battery into the drain pipe. A sealing cap is fitted over the anode end of the envelop so as to form between the cap and the anode end a sealed chamber within the confines of which said drain pipe is secured to the anode plate. Said drain pipe extends through the sealing cap and is sealingly fitted in the vent hole formed in the lower end wall of the housing for open communication with the exterior of the housing, whereby the gas discharged from each battery is passed through the sealed chamber and through the drain pipe to be successfully expelled out of the housing while being prevented by said sealing cap from diffusing inside of the housing. Each of the drain pipes is made of electrically conductive material and has its portion outside of the sealing cap in contacting engagement with a contact piece disposed inside of the housing for electrical connection with the motor and the terminal pins. The above unitary construction of the battery having the drain pipe integrally secured to the envelop thereof can facilitate the assembly of the batteries into the housing as well as the sealing of the drain pipes, in addition to assuring easy electrical connection with the motor and the terminal pins by better utilization of the drain pipes as the respective anode terminals, which is therefore a still further object of the present invention.

These and still other advantageous features of the present invention will become more apparent from the following description of the preferred embodiments when taken in conjunction with the attached drawings.

DESCRIPTION OF THE PREFERRED EMBODIMENTS

Figure 1:
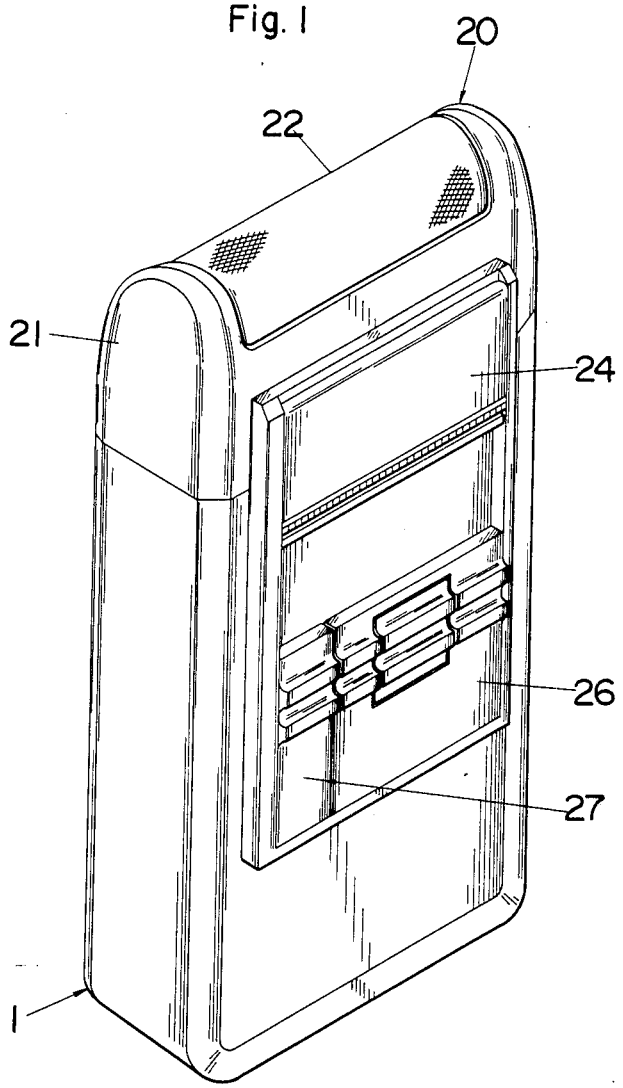
FIG. 1 is a perspective view of an electric shaver in accordance with a first embodiment of the present invention.

Referring now to FIGS. 1 to 6, there is illustrated an electric shaver in accordance with a first embodiment of the present invention. The shaver comprises a flat-shaped tubular housing 1 closed at its bottom by an integrally formed lower end wall 2 and a shaving head 20 mounted on the upper end of the housing 1. The shaving head 20 includes a head frame 21 supporting an arcuately shaped outer shearing foil 22 and an inner blade assembly (not shown) carrying a plurality of inner blades for shearing engagement with the inner surface of the shearing foil 22. Mounted within the housing 1 is an electric motor 30 which is operatively connected to the inner blade assembly through a linkage which converts the rotary motion of an output rotor shaft 31 of the motor 30 into a reciprocatory motion of the inner blade assembly. This linkage is of conventional design which includes a cam wheel 32 receiving the output rotor shaft 31 and having thereon an eccentric shaft 33 parallel to the output rotor shaft 31, and a vibrator 34 having a pair of resilient legs 35 extending downwardly from the opposite ends of a center rigid segment 36. The vibrator 34 is movably held within the upper portion of the housing 1 with the free ends of its resilient legs 35 secured to the upper end of the housing 1. A joint element 37 extends from the center rigid segment 36 for connection with said eccentric shaft 33 so that the vibrator 34 is driven to reciprocate upon energization of the motor 30. Also formed on the center rigid segment 36 of the vibrator 34 is an integral stud 38 which extends through a slot 12 in the upper wall 11 of the housing 1 for connection with the inner blade assembly. Said stud 38 is in water-tight sealing engagement with the periphery of the slot 12 by means of a sealing sleeve 40 in order to allow the shaving head 20 to be used with a wet shaving lather as well as to be washed with water for flushing away clipped hairs, while preventing the water from entering the interior of the housing 1. A trimmer 24 which is selectively driven by said motor 30 is mounted on the front face of the housing 1 at a portion below the shaving head 20.

Also mounted within the housing 1 are a pair of main and reserve rechargeable batteries 50 and 60, such as nickel-cadmium batteries which will discharge gases upon being recharged, to be connected to the motor 30 through an electric circuit capable of energizing the motor 30 from either of the main battery 50 or reserve battery 60. The electric circuit includes switching contacts which are operable by main and auxiliary switch handles 26 and 27 slidably held on the housing 1. The auxiliary switch handle 27 is only allowed to move into its on-position after the main switch handle 26 has moved into its on-position and is thus responsible for continuously energizing the motor 30 from the reserve battery 60 when the main battery 50 is exhausted, thus obviating the interruption of the shaving operation. The reserve battery 60 has a smaller capacity than the main battery 50 and may be of capacity for affording only one estimated complete shave. Thus, the exhaustion of the main battery 50 is indicative of the need for recharging the batteries 50 and 60 but will not cause inconvenience of interrupting the shaving operation being performed by the shaver. The recharging of the batteries 50 and 60 is effected by the use of an external battery charger (not shown) which includes a conventional charging circuit and has its input connected to the usual AC power source. For this purpose, the housing 1 is provided with terminal pins 28 for connection with the external battery charger.

Said main and reserve batteries 50 and 60 are disposed on both sides of the motor 30 within the housing 1, as being held together with the motor 30 on an inner board 10 which is inserted in the housing 1 and secured thereto. Said inner board 10 is formed on its upper portion with brackets 13, 14, and 15 respectively for holding the motor 30, main battery 50, and reserve battery 60 in place. Also formed on the lower end of the inner board 10 are lugs 16, 17, and 18 respectively for supporting lower ends of the main and reserve batteries 50 and 60 and for supporting a pair of said terminal pins 28 electrically connected to the batteries 50 and 60, these lugs abutting against the inside surface of the lower end wall 2 with a sealing member 42 interposed therebetween. Said terminal pins 28 extend through the lower end wall 2 and project into a recess 3 which is formed centrally in the lower end wall 2 to have a raised bottom 4 and a depending sidewall 6. Apertures 5 are formed in the raised bottom 4 for receiving said terminal pins 28 together with sealing rings 43 integrally formed with said sealing member 42 for establishing water-tight sealing between the terminal pins 28 and the raised bottom 4.

Figure 3:
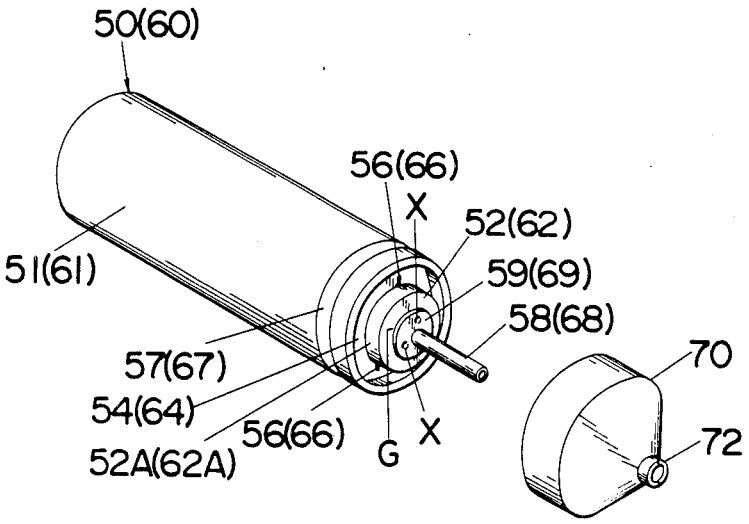
FIG. 3 is a perspective view of a main or reserve rechargeable battery and a complementary sealing cap employed in the above electric shaver.
Figure 4:
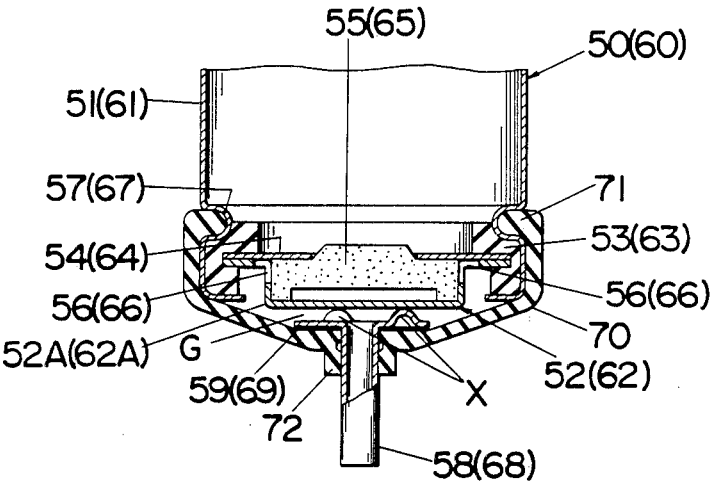
FIG. 4 is an enlarged sectional view of a gas-discharge end of the above battery.

Each of the main and reserve batteries 50 and 60 comprises a sealed envelop 51, 61 which is closed at its gas-discharge end by an anode plate 52, 62 (see FIGS. 3 and 4). The anode plate 52, 62 is electrically insulated from the envelop 51, 61 serving as a cathode and is secured thereto by means of a sealing annulus 53, 63. Said anode plate 52, 62 is of electrically conductive material and consists of an end plate 54, 64 and a hat 52A 62A fixed to the end plate 54, 64 to enclose therebetween a valve member 55, 65 which has a portion extending through the end plate 54, 64 to be exposed to the interior of the battery 50, 60. Said valve member 55, 65 will open, when the gas pressure developed within the battery 50, 60 exceeds a predetermined level, so that the excess amount of the gas produced within the battery upon charging thereof will escape from the inside of the battery through the valve member 55, 65 and further through pores 56, 66 formed at the juncture of the hat 52A, 62A with the end plate 54, 64 of the anode plate 52, 62. A sealing cap 70 is fitted over the gas-discharge end of each of the envelops 51 and 61 with its rearward projection 71 sealingly engaged in an annular groove 57, 67 formed around the envelop 51, 61, thus forming between the sealed cap 70 and the anode plate 52, 62 a sealed chamber into which the gas is discharged from the battery 50, 60. Extending in a sealing manner through a hub 72 of each sealing cap 70 is a drain pipe 58, 68 which is fixedly secured to the anode plate 52, 62 with an integral flange 59, 69 at its one end being welded thereto at portions indicated by X in such a manner as to leave an opening or gap G between the anode plate 52, 62 and the flange 59, 69, thus establishing a gas discharging path leading from said valve member 55, 65 to the drain pipe 58, 68 through said gap G.

The main and reserve batteries 50 and 60, thus constructed to have the drain pipes 58 and 68 rigidly welded to the individual anode plates 52 and 62, can be assembled on said inner board 10 simply by inserting the drain pipes 58 and 68 through bores 19 respectively formed in said lugs 17 and 18 of the inner board 10. The drain pipes 58 and 68 have the other end portions extending through respective sealing rings 44 and 45 interposed between the lower end wall 2 and the corresponding lugs 17 and 18, and further extending into vent holes 9 respectively formed in the lower end wall 2, whereby the gas discharged from the batteries 50 and 60 can be successfully drained out of the housing 1 by way of said drain pipes 58 and 68 without being diffused inside of the housing 1.

Figure 5:
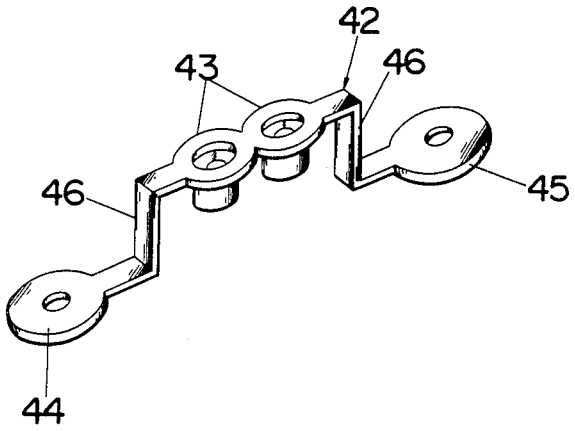
FIG. 5 is a perspective view of a sealing member employed for sealing of the lower end portion of the above electric shaver.

As shown in FIG. 5, said sealing rings 44 and 45 for the drain pipes 58 and 68 are integrally molded into said single sealing member 42 and are interconnected by integral stems 46 to said sealing rings 43 for said terminal pins 28. By the use of this sealing member 42, a single operation of positioning the sealing member 42 on the inner surface of the lower end wall 2 is enough for water-tight sealings with respect to the drain pipes 58 and 68 and to the terminal pins 28, thus facilitating the assembly of the shaver. It is to be noted at this time that the inside diameter of each drain pipe 58, 68 is so dimensioned as to prevent the entry of the water from outside but to allow the discharge of the gas from the batteries 50 and 60.

Each of the drain pipes 58 and 68 is made of electrically conductive material to serve as an anode terminal and is in contacting engagement with a contact piece 29 embedded in the corresponding lug 17, 18 for connection with the motor 20 and with the terminal pins 28. Each of the contact pieces 29 has its portion projected radially into the bore 19 of the corresponding lug 17, 18 so that the electrical connection of the batteries 50 and 60 with the circuits of the shaver can be easily effected simultaneously at the time of placing the batteries 50 and 60 in position by inserting the drain pipes 58 and 68 into the bores 19 of the respective lugs 17 and 18.

Figure 2:
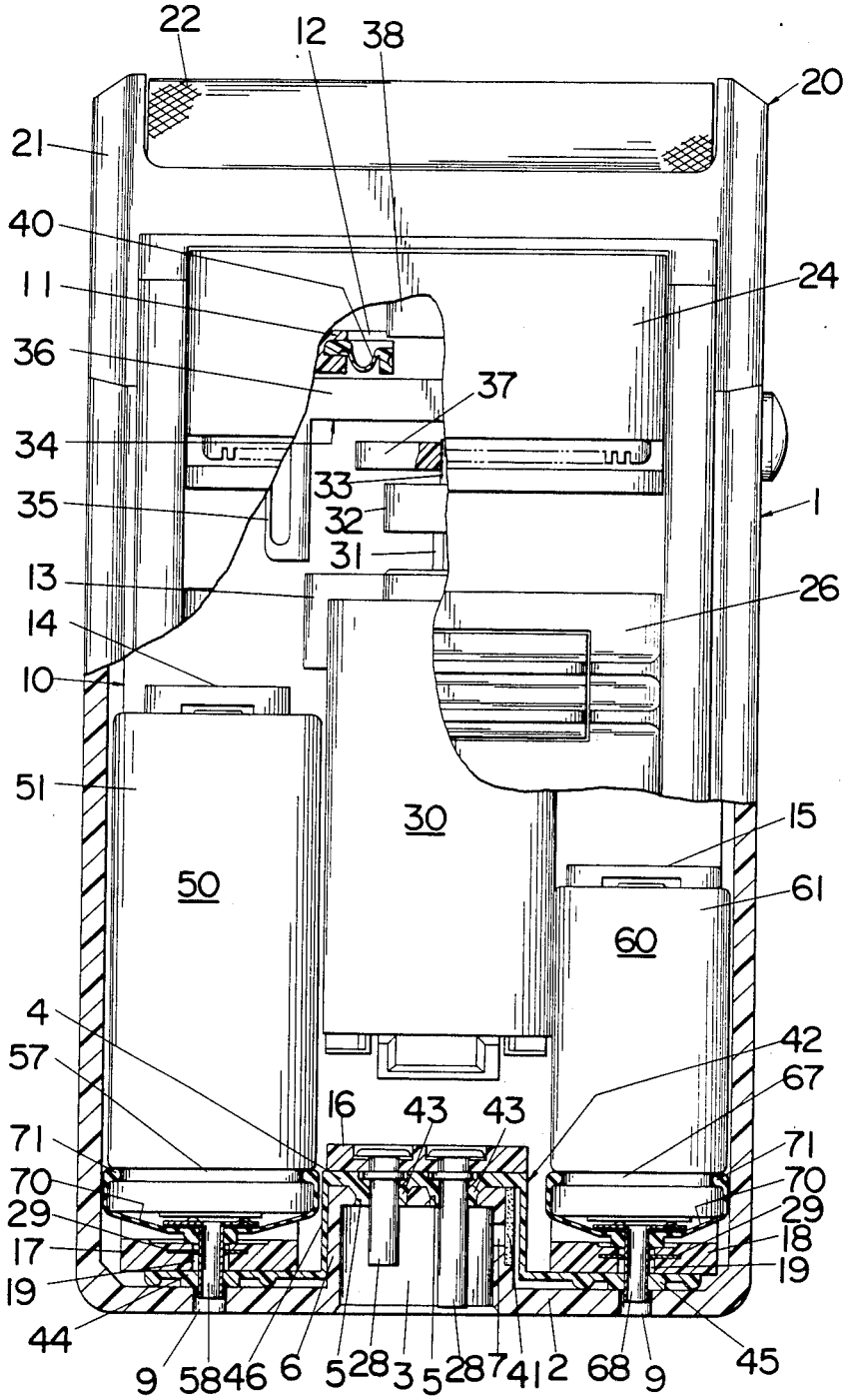
FIG. 2 is a fragmentary sectional view of the electric shaver with some parts being shown in front elevation.
Figure 6:
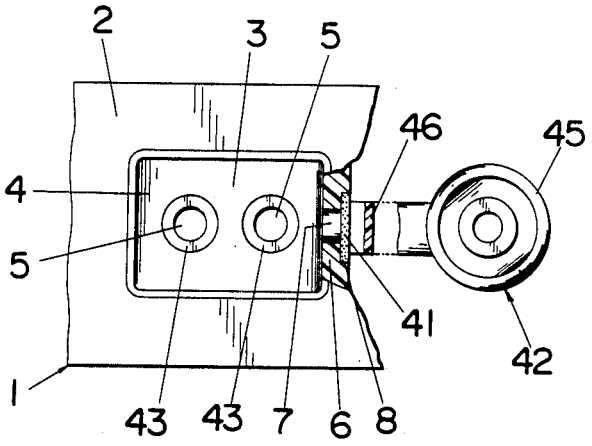
FIG. 6 is a fragmentary bottom view of the electric shaver with a portion being cut away.

Notwithstanding the provision of the sealing caps 70 for the batteries 50 and 60, it is possible that the gas discharged from the batteries would leak through the sealing caps 70 to diffuse inside of the housing 1. The gas if spread inside of the housing 1 could explode with the arcing of switching contacts or the motor of the shaver, subjecting the shaver to damage or even the user to injury. Therefore, the above potential hazard should be eliminated for safety purpose. To this end, the housing 1 is formed in its lower end wall 2 with a window 7 which is screened with a filter 41 capable of passing the gas out of the housing 1 while inhibiting the entry of the water or dust into the housing 1. The filter 41 is in the form of a porous membrane such as made of ethylene tetrafluoride having a number of minute holes of about 1 μm in diameter for selective passage of the gas therethrough. As shown in FIGS. 2 and 6, the window 7 is formed in the sidewall 6 surrounding said recess 3 so that the filter 41 covering the window 7 is kept away from being in contact with the finger of the user or the like articles, which in addition to the filter 41 itself being seated in an enlarged sink 8 at the innermost end of the window 7, protects against the accidental breakage of the filter 41 during the use of the shaver.

Figure 7:
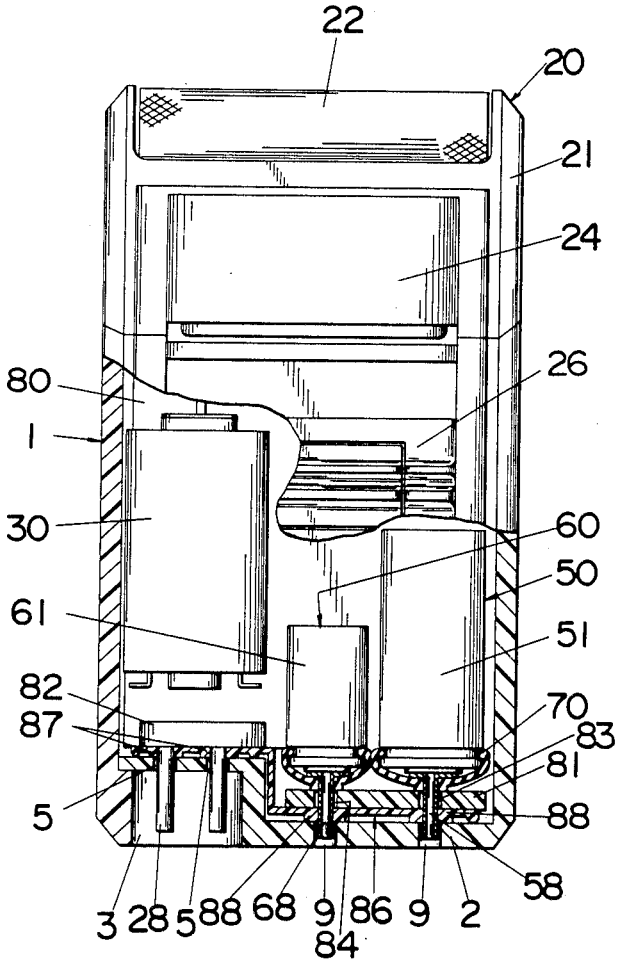
FIG. 7 is a fragmentary sectional view with some parts being shown in front elevation of an electric shaver in accordance with a second embodiment of the present invention.

Referring to FIG. 7, there is illustrated an electric shaver in accordance with a second embodiment of the present invention which is similar in construction to the first embodiment except for the spatial arrangement of the motor 20 and the main and reserve batteries 50 and 60. Like numerals designate like parts as in the first embodiment. The motor 20 is offset toward one lateral side of the housing 1 and the main battery 50 is disposed on the other side of the housing 1 with the reserve battery 60 disposed therebetween. An inner board 80 fixedly inserted in the housing 1 has at its lower end a first lug 81 for supporting batteries 50 and 60 and a second lug 82 for supporting a pair of terminal pins 28 connected to the batteries. The terminal pins 28 are positioned downwardly of the motor 20 as they extend through apertures 5 into a recess 3 formed at the lateral end of the lower end wall 2 of the housing 1. The main and reserve batteries 50 and 60 have their drain pipes 58 and 68 inserted through bores 83 and 84 of the first lug 81 and further extended into corresponding vent holes 9 formed in the lower end wall 2 of the housing 1 in order to drain the gas discharged from the batteries out of the housing 1, in the same manner as in the previous embodiment. A single sealing member 86 integrally formed with a corresponding number of sealing rings 87 and 88 for said terminal pins 28 and drain pipes 58 and 68 is fitted between the lower end wall 2 and the first and second lugs 81 and 82 for effecting the simultaneous water-tight sealing treatment to the lower end wall 2 of the housing 1.

Figure 8:
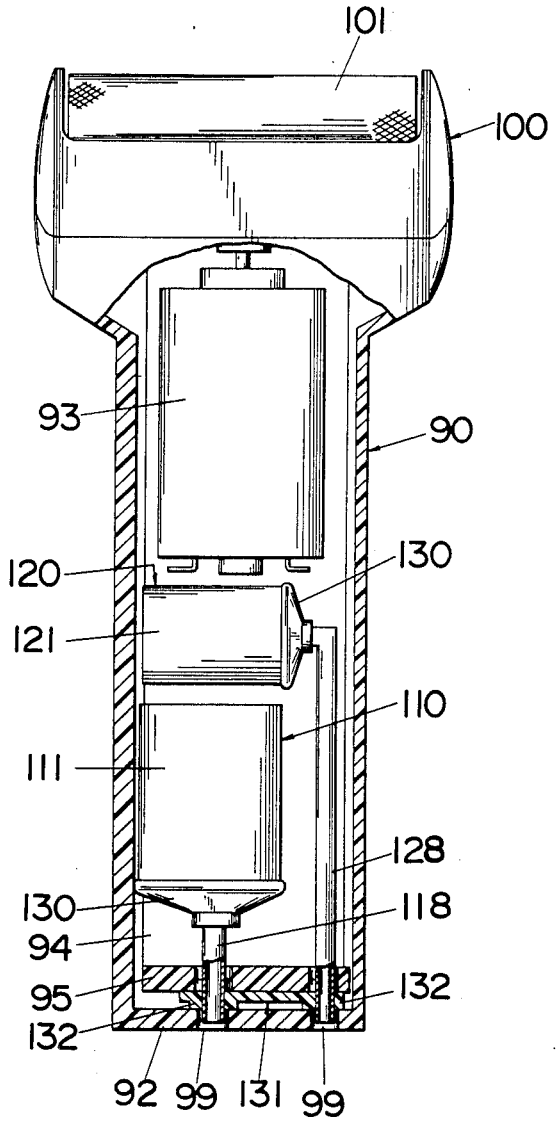
FIG. 8 is a fragmentary sectional view with some parts being shown in front elevation of an electric shaver in accordance with a third embodiment of the present invention.

FIG. 8 illustrates an electric shaver in accordance with a third embodiment of the present invention which comprises an axially elongate tubular housing 90 with a laterally elongate upper end for mounting thereon a likewise laterally elongate shaving head 100, said shaving head 100 being cooperative with the housing 90 to present a generally T-shaped configuration. The housing 90, which is closed at its bottom by an integrally formed lower end wall 92, incorporates a motor 93 together with main and reserve batteries 110 and 120, the motor 93 being drivingly connected to an inner blade assembly (not shown) for reciprocatory movement thereof relative to an outer shearing foil 101 of the shaving head 100. The main and reserve batteries 110 and 120 are for energizing the motor 93 through the manipulation of a switch handle (not shown) and connected to like terminal pins (not shown) for the recharging purpose. Fixedly secured to the inside of the housing 90 is an inner board 94 on which are mounted said motor 93 together with the main and reserve batteries 110 and 120 in such a manner that the motor 93 is located in the upper end portion of the housing 90 while the main battery 110 is positioned in the lower end portion of the housing 90 with the reserve battery 120 positioned therebetween. The main and reserve batteries 110 and 120 are of the same construction as those of the first embodiment to have individual drain pipes 118 and 128 fixedly welded to its envelops 111 and 121 and include like sealing caps 130.

The drain pipe 128 of the reserve battery 120, which is disposed with its axis perpendicular to that of the main battery 110, is rather elongate and bent so as to run alongside the main battery 110 and extend into one of vent holes 99 formed in the lower end wall 92 of the housing 90 through a lug 95 at the lower end of said inner board 94. The drain pipe 118 of the main battery 110 runs downwardly in parallel relation to the substantial portion of the drain pipe 128 of the reserve battery 120, extending through said lug 95 into the other vent hole 99. Likewise in the first embodiment, a single sealing member 131 integrally formed with sealing rings 132 for the drain pipes 118 and 128 is fitted between the lug 95 and the lower end wall 92 for easy water-tight sealing treatment with respect to the lower end wall 92. Said sealing member 131 is also formed integrally with sealing rings (not shown) for the terminal pins.

Figure 9:
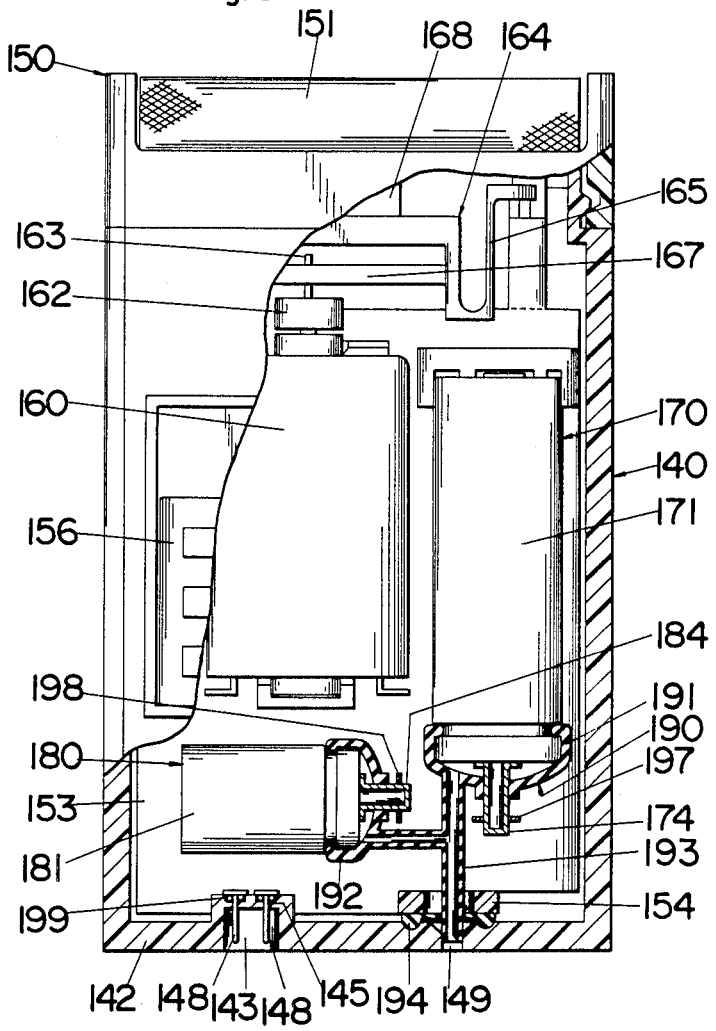
FIG. 9 is a fragmentary sectional view with some parts being shown in front elevation of an electric shaver in accordance with a fourth embodiment of the present invention.
Figure 10:
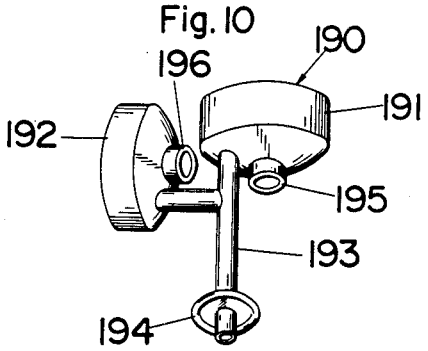
FIG. 10 is a perspective view of a combination sealing cap to be fitted over the discharge ends of the main and reserve batteries employed in the embodiment of FIG. 9.

Referring to FIGS. 9 and 10, there is shown a fourth embodiment of the present invention which is similar in construction to the first embodiment except for a gas-discharging path leading from main and reserve batteries 170 and 180. The electric shaver of this embodiment comprises a housing 140 closed at its bottom by an integral lower end wall 142 and mounting thereon a shaving head 150. The housing 140 accommodates a motor 160 drivingly connected through a rotary-to-reciprocatory motion translating linkage to an inner blade assembly (not shown) for movement thereof in relation to an outer shearing foil 151 of the shaving head 150, said linkage being of the same construction as that of the first embodiment to include in combination a cam wheel 162 with an eccentric shaft 163, and a vibrator 164 with resilient legs 165, a joint element 167, and a stud 168. The motor 160 is energized by the manipulation of a switch handle 156 either from a main rechargeable battery 170 or reserve rechargeable battery 180, both mounted within the housing 140 as being held on an inner board 153 secured to the inside of the housing 140. Each of the main and reserve batteries 170 and 180 is of similar construction to that employed in the first embodiment except that an end-closed terminal pipe 174, 184 serving as an anode terminal extends from the anode end of an envelop 171, 181 of each battery in place of said drain pipe 58, 68 and further that a combination sealing cap 190 is employed in place of said individual sealing caps 70. The combination sealing cap 190 is integrally molded into one piece construction having a pair of cap members 191 and 192 connected by a single drain pipe 193 of generally Y-shaped configuration, the bifurcated ends of which are blended into the respective cap members 191 and 192 for intercommunication therebetween. The drain pipe 193 has its lower end portion extending through a lug 154 at the lower end of said inner board 153 and further into a vent hole 149 formed in the lower end wall 142 of the housing 140, providing said gas-discharge path leading from the batteries 170 and 180 to the exterior of the housing 140. Integrally formed with the lower end portion of the drain pipe 193 is a sealing ring 194 which is pressedly inserted between the lower end wall 142 and the lug 154 for establishing water-tight sealing between the vent hole 149 and the drain pipe 193, preventing the outside water from entering the interior of the housing 140.

Said terminal pipes 174 and 184 extend in a sealing manner through hubs 195 and 196 of each cap member 191 and 192 so as to be in contacting engagement with a contact piece 197 and 198 located outside thereof for electrically connection with the motor 160 as well as with terminal pins 148. Each of the terminal pins 148, which are adapted for use to be connected to an external battery charger (not shown) for recharging the batteries, is secured at its one end to the lower end wall 142 and extends through a corresponding aperture 145 in the lower end wall 142 into a recess 143 thereof with a sealing ring 199 interposed between the secured end of each terminal pin 148 and the aperture 145, ensuring water-tight sealing therebetween.

What is claimed is:

1. An electric shaver comprising:

a housing with a lower end wall;

a shaving head mounted on the upper end of the housing;

an electric motor mounted centrally within the housing and drivingly connected to the shaving head through a watertight sealing;

a pair of main and reserve gas-producing rechargeable batteries both mounted within the housing adjacent said lower end wall and on both lateral sides of the motor and connected for energizing said motor; each battery having an anode plate facing said lower end wall; said batteries being closer to the lower end wall than the lower end of the motor so as to define a space between the batteries and under the lower end of the motor;

a recess in said lower end wall having a raised bottom projecting into said space between the batteries;

terminal pins adapted in use to be connected to an external battery charger for feeding an electric charging current to said rechargeable batteries;

each of the terminal pins projecting through a complementary aperture formed in the raised bottom and within said recess for connection with an external battery charger;

said batteries being provided with duct means connected to said anode plates for passing therethrough the gas discharged from the batteries, said duct means including a pair of drain pipes of which the outlet ends are fitted in a pair of complementary vent holes formed in the lower end wall of the housing directly under each battery for passing gas discharged from the anode plates out of the housing; and the lower end wall portions between the terminal pins and their corresponding apertures and between the drain pipe and its corresponding vent hole being sealed in a water-tight manner.

2. An electric shaver as set forth in claim 1, wherein said recess has a depending sidewall, said sidewall of the recess being formed therein with a ventilation window screened by a filter which allows the gas to pass out of the housing but prevents outside water from entering interior of the housing.

3. An electric shaver as set forth in claim 1, wherein each of said rechargeable batteries including a sealed envelop having its anode end slotted for discharging the gas produced from the battery upon charging thereof; said drain pipe being made of electrical conducting material and being rigidly secured to said anode plate formed at the anode end of each battery in such a manner as to leave therebetween an opening for leading the gas discharged from the battery into the drain pipe; a sealing cap being fitted over the anode end of the envelope so as to form between the cap and the anode end a sealed chamber within the confines of which said drain pipe is secured to the anode plate; said drain pipe extending through the sealing cap and sealingly fitted in the vent hole in the lower end wall of the housing for open communication with the exterior of the housing, whereby the gas discharged from each battery is passed through the sealed chamber and through the drain pipe to be expelled out of the housing while being prevented by said sealing cap from diffusing inside of the housing; and said drain pipe of each battery having its portion outside of the sealing cap in contacting engagement with a complementary contact piece disposed inside of the housing for electrical connection with the motor as well as the terminal pins.

4. An electric shaver as set forth in claim 1 wherein therein is a sealing means extending across the inside of said lower bottom wall which has openings defining sealing surfaces around the terminal pins apertures and the gas drain pipe vent holes.

* * * * *